US006857149B2

(12) United States Patent
Hoggatt et al.

(10) Patent No.: US 6,857,149 B2
(45) Date of Patent: Feb. 22, 2005

(54) SLEEP SUPPORT SYSTEM

(76) Inventors: Todd Damon Hoggatt, 5747 W. Vista Ave., Glendale, AZ (US) 85301; Emily Jo Hoggatt, 5747 W. Vista Ave., Glendale, AZ (US) 85301

( * ) Notice: Subject to any disclaimer, the term of this patent is extended or adjusted under 35 U.S.C. 154(b) by 145 days.

(21) Appl. No.: 10/099,386

(22) Filed: Mar. 15, 2002

(65) Prior Publication Data

US 2003/0172462 A1 Sep. 18, 2003

(51) Int. Cl.[7] ..... A47C 20/02
(52) U.S. Cl. ..... 5/632; 5/652; 5/657
(58) Field of Search ..... 5/630, 632, 638, 5/640, 652, 657, 503.1, 507.1, 636, 658

(56) References Cited

U.S. PATENT DOCUMENTS 245,639 A * 8/1881 Lay
1,260,929 A * 3/1918 Maxcy
2,107,962 A * 2/1938 Sheasby
3,929,309 A * 12/1975 De Vore
5,177,823 A * 1/1993 Riach
5,480,713 A * 1/1996 Sasaki et al.
5,865,181 A * 2/1999 Spence, Jr.
6,081,947 A * 7/2000 Disher
6,151,734 A * 11/2000 Lawrie
6,397,414 B1 * 6/2002 Lloyd

* cited by examiner

*Primary Examiner*—Ten Pham Luu
(74) *Attorney, Agent, or Firm*—Stoneman Law Offices, Ltd.; Martin L. Stoneman; Benjamin K. Erlick

(57) ABSTRACT

A sleep support system for comfortably supporting a user during sleep. More particularly, a sleep support system for face-down sleep in essentially a sitting position. The system is adapted for use with equipment and fixtures commonly found in patient recovery rooms, such as hospital beds and over-bed tables. The system provides comfortable head and arm support with a plurality of user-selectable positional adjustments. The system is foldable and portable. The system may be adapted for use with a wheelchair.

26 Claims, 6 Drawing Sheets

SLEEP SUPPORT SYSTEM

BACKGROUND

This invention relates to a sleep support system for comfortably supporting a user during sleep. More particularly, it relates to a sleep support system for face-down sleep in essentially a sitting position, for use with at least one support, adapted to support a user's body so that the user's buttocks and thighs are in an approximately horizontal position.

A consensus exists within most scientific and medical communities supporting a correlation between sleep and the health of an individual. Numerous studies have shown a link between chronic sleep disruption and poor physical and mental well-being.

The importance of sleep disruption as a public health problem has been recognized by both national and international groups, including the World Health Organization. In a 1996 study undertaken by the World Health Organization, researchers reported that over a quarter of the 26,000 primary care patients in 15 surveyed countries experienced chronic sleep disruptions. Individuals recognized as being most negatively affected by sleep disruption were recovering patients and individuals with long-term medical conditions. Sleep disruption in a recovering patient can slow the progress of recuperation, thereby increasing the risk of complications and subsequent cost of health care for the patient.

A significant number of medical conditions and procedures require that patients remain in specific and/or restricted positions during rest or sleep. Many individuals are limited to sleeping in an upright position. Physicians, medical practitioners and patients have known for some time that for many conditions, an upright sleep position can aid in relieving discomfort, thereby increasing the duration and quality of sleep. Patients with moderate to advanced congestive heart failure having pulmonary edema (pooling of fluid in lungs) find that the resulting dyspnea (difficulty in breathing) is often relieved by upright sleep. Burn patients and patients with injuries to the back of the body often use an upright sleep position to manage pain. Other common conditions that benefit from upright sleep include gastro esophageal reflux disorder (backward flow up into the esophagus of acidic stomach contents) and obstructive sleep apnea syndrome (periodic short term blockage of the airway during sleep).

Standard patient recovery rooms are characteristically equipped with an adjustable bed and a rolling over-bed table. Most standard adjustable hospital beds are designed to provide a limited range of user positioning. Typically, the upper supporting portion of the bed may be raised to an inclined position of less than 90 degrees. Limited bed adjustability forces most upright sleeping patients and attending staff to improvise makeshift upright sleep supports using pillows and blankets.

Based on the above discussion, it is clear that many individuals could benefit from a system designed to facilitate comfortable upright sleep. Introduction of a relatively inexpensive system would allow both inpatient health care providers, and home-based caregivers, the greatest flexibility in providing upright sleep support systems to patient recovery rooms. In addition, the need exists for a lightweight portable system that will allow for set-up and removal by any attending patient-care staff member or home-care individual. Further, a need exists for a system that provides a compact design that can utilize existing furnishings, fixtures and equipment for primary support, limiting the impact to individual patient space and storage requirements.

OBJECTS OF THE INVENTION

A primary object and feature of the present invention is to provide a system for upright sleep. It is a further object and feature of the present invention to provide such a system that is lightweight, portable (easy to manipulate, hold and transport). It is an additional object and feature of the present invention to provide such a system that is simple to use and is adjustable to a wide range of user-selected positions. It is a further object and feature of the present invention to provide such a system that may be mounted to a secondary support fixture, such as an over-bed table or wheelchair. Additionally, it is an object and feature of the present invention to provide such a system that is foldable into a compact form that is easily stowed. It is a further object and feature of the present invention to provide such a system that is easy to manufacture, assemble and service.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a sleep support system for face-down sleep, in essentially a sitting position, for use with at least one body support adapted to support a user's body so that the user's buttocks and thighs are in an approximately horizontal position, the system comprising in combination: at least one face support structured and arranged to support a user's face during face-down sleep with the user's nose unobstructed for breathing; and at least one intermediate support, adapted to be supported by at least one primary support structured and arranged to support such intermediate support above a floor; wherein such at least one intermediate support is structured and arranged to support such at least one face support in a location approximately above a position of the user's thighs in such manner that the user's body is in a comfortable position for face-down sleep; wherein such at least one intermediate support comprises at least one face-incline-position adjuster structured and arranged to adjust the incline-position of support of the user's face for preferred sleep; and wherein at least one upper portion of such at least one face support comprises at least one surface portion structured and arranged to be cleanable and moisture-permeable, such at least one surface portion adapted to contact at least one portion of the user's face during face-down sleep.

Additionally, it provides such a system wherein such sleep support system is portable and such at least one intermediate support comprises at least one movement resistor structured and arranged to resist relative movement between such at least one intermediate support and the at least one primary support when in adjacent position. Further, it provides such a system wherein such at least one intermediate support comprises at least one arm support structured and arranged to support at least one portion of the user's forearm in a comfortable position for sleep, and at least one upper portion of such at least one arm support comprising at least one arm-support surface structured and arranged to be cleanable and moisture-permeable, such at least one arm-support surface portion adapted to contact at least one portion of the user's arm during face-down sleep. Moreover, it provides such a system wherein such at least one intermediate support comprises at least one arm-incline-position adjuster structured and arranged to provide incline-position adjustment of such at least one arm support. Further, it provides such a system wherein: such at least one intermediate support comprises at least one lower support member and at least one upper support member; an angle connection structured and arranged to connect such at least one lower support member at an acute angle with such at least one upper support member; and such at least one lower support member is structured and arranged to support such at least one face-incline-position adjuster on such at least one upper surface portion. Additionally, it provides such a system wherein such at least one upper support member is structured and arranged to support such at least one arm support. It further provides such a system wherein such angle connection comprises at least one hinge structured and arranged to hinge such at least one lower support member to such at least one upper support member. Additionally, it provides such a system wherein such at least one face-incline-position adjuster and such at least one arm-incline-position adjuster are independently adjustable. Further, it provides such a system wherein such at least one upper support member comprises: at least one arm-coplanar-position adjuster structured and arranged to provide coplanar position adjustment of such at least one arm support; wherein such at least one arm-incline-position adjuster and at least one arm-coplanar-position adjuster are independently adjustable. Moreover, it provides such a system wherein each such at least one face-incline-position adjuster comprises at least one retainer, structured and arranged to retain such at least one face-incline-position adjuster in a selected position, while the user is supported by such sleep support system during the face-down sleep. Furthermore, it provides such a system wherein each such at least one arm-incline-position adjuster comprises at least one retainer, structured and arranged to retain such at least one arm-incline-position adjuster in a selected position, while the user is supported by such sleep support system during the face-down sleep. Additionally, it provides such a system wherein each such at least one arm-coplanar-position adjuster comprises at least one retainer, structured and arranged to retain such at least one arm-coplanar-position adjuster in a selected position, while the user is supported by such sleep support system during the face-down sleep. In addition, it provides such a system wherein such at least one movement-resistor comprises at least one slip-resistant friction padding on an at least one lower surface portion of such at least one lower support. Moreover, it provides such a system wherein such at least one movement-resistor comprises at least one clamp structured and arranged to secure such at least one intermediate support with at least one primary support.

In accordance with another preferred embodiment hereof, this invention provides a sleep support system for face-down sleep in essentially a sitting position, for use with at least one body support, adapted to support a user's body so that the user's buttocks and thighs are in an approximately horizontal position, the system comprising in combination: at least one face support structured and arranged to support a user's face during face-down sleep with the user's nose unobstructed for breathing; and at least one intermediate support; at least one primary support structured and arranged to support such intermediate support above a floor; wherein such at least one intermediate support is structured and arranged, in combination with such primary support, to support such at least one face support in a location approximately above a position of the user's thighs in such manner that the user's body is in a comfortable position for face-down sleep; wherein such at least one intermediate support comprises at least one face-incline-position adjuster structured and arranged to adjust the incline-position of support of the user's face for preferred sleep; and wherein at least one upper portion of such at least one face support comprises at least one surface portion structured and arranged to be cleanable and moisture-permeable, such at least one surface portion adapted to contact at least one portion of the user's face during face-down sleep. Additionally, it provides such a system wherein such at least one primary support comprises such at least one body support. Additionally, it provides such a system wherein such at least one primary support is removably rollable into a position such that, when such at least one intermediate support is being supported by such at least one primary support, such at least one face-support is in a location approximately above a position of the user's thighs. Further, it provides such a system wherein such at least one intermediate support is portable, and such at least one movement-resistor comprises at least one clamp structured and arranged to secure such at least one intermediate support with at least one primary support.

In accordance with another preferred embodiment hereof, this invention provides a sleep support system for face-down sleep in essentially a sitting position, comprising, in combination: at least one body support adapted to support a user's body so that the user's buttocks and thighs are in an approximately horizontal position; at least one face support structured and arranged to support a user's face during face-down sleep with the user's nose unobstructed for breathing; and at least one intermediate support; at least one primary support structured and arranged to support such intermediate support above a floor; wherein such at least one intermediate support is structured and arranged, in combination with such primary support, to support such at least one face support in a location approximately above a position of the user's thighs in such manner that the user's body is in a comfortable position for face-down sleep; wherein such at least one intermediate support comprises at least one face-incline-position adjuster structured and arranged to adjust the incline-position of support of the user's face for preferred sleep; and wherein at least one upper portion of such at least one face support comprises at least one surface portion structured and arranged to be cleanable and moisture-permeable, such at least one surface portion adapted to contact at least one portion of the user's face during face-down sleep.

Additionally, it provides such a system wherein such at least one body support comprises such at least one primary support, and such at least one primary support is removably rollable into a position such that, when such at least one intermediate support is being supported by such at least one primary support, such at least one face-support is in a location approximately above a position of the user's thighs. Moreover, it provides such a system wherein such at least one movement-resistor comprises at least one clamp structured and arranged to secure such at least one intermediate support to such at least one primary support.

DETAILED DESCRIPTION OF A PREFERRED EMBODIMENT OF THE INVENTION

Figure 1:
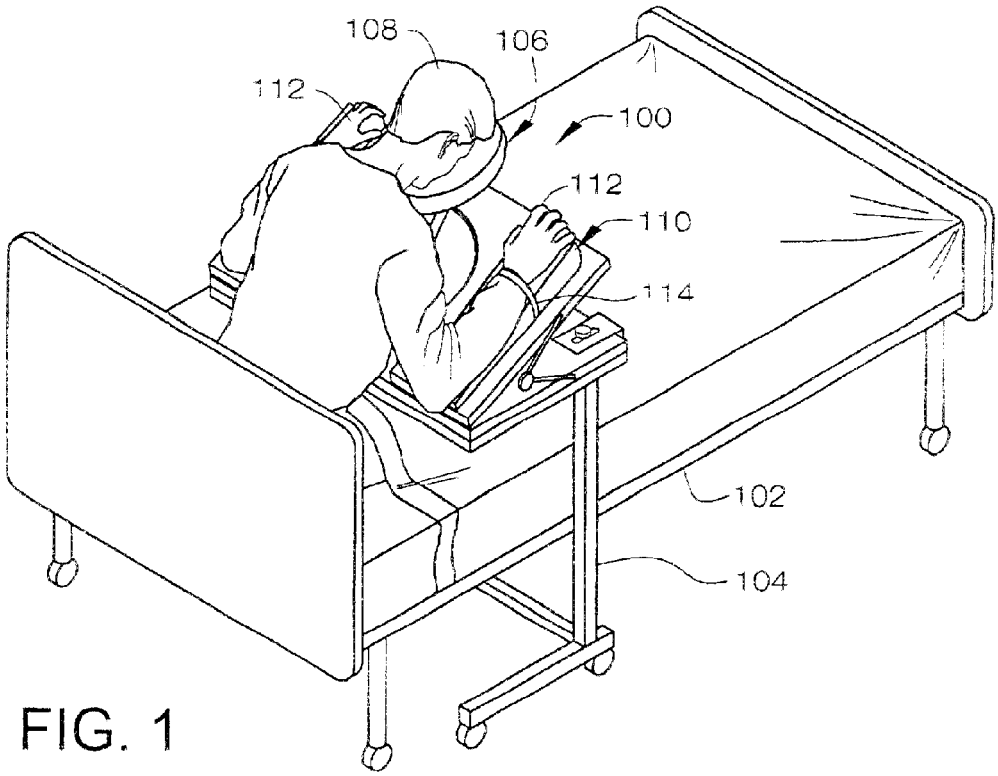
FIG. 1 is a perspective view of an individual using the sleep support system in conjunction with a standard hospital bed and over-bed table according to a preferred embodiment of the present invention.

Referring now to the drawings, FIG. 1 is a perspective view of an individual, in an essentially sitting position, using the sleep support system 100 in conjunction with a standard hospital bed 102 and over-bed table 104 according to a preferred embodiment of the present invention. In the present embodiment, an "essentially sitting position" refers to the position taken by a person of typical form where the head is equal to or above the level of the waist, while the buttocks and thighs are in an approximately horizontal position. Preferably, the sleep support system 100 is used in conjunction with the standard furnishings and equipment commonly found in most hospital patient recovery rooms (it should be noted that by utilizing an over-bed or similar table, the system is especially suitable for non-institutional use). Preferably, the sleep support system 100 is supported by at least one separate primary support fixture, such as an over-bed table 104 (as shown) or wheelchair (herein embodying at least one primary support). At least one adjustable head support assembly 106 (herein embodying at least one face support structured and arranged to support a user's face during face-down sleep with the user's nose unobstructed for breathing) is preferably provided to comfortably hold the head 108 of the user at a selected position, as shown. Preferably, at least one adjustable arm support assembly 110 is provided to support the arm 112 of the user at a selected position. An optional arm retention strap 114 is illustrated, assisting the user in maintaining arm position over the arm support assembly 110. Preferably, the individual using the sleep support system may adjust the positions of all body supports.

Figure 2:
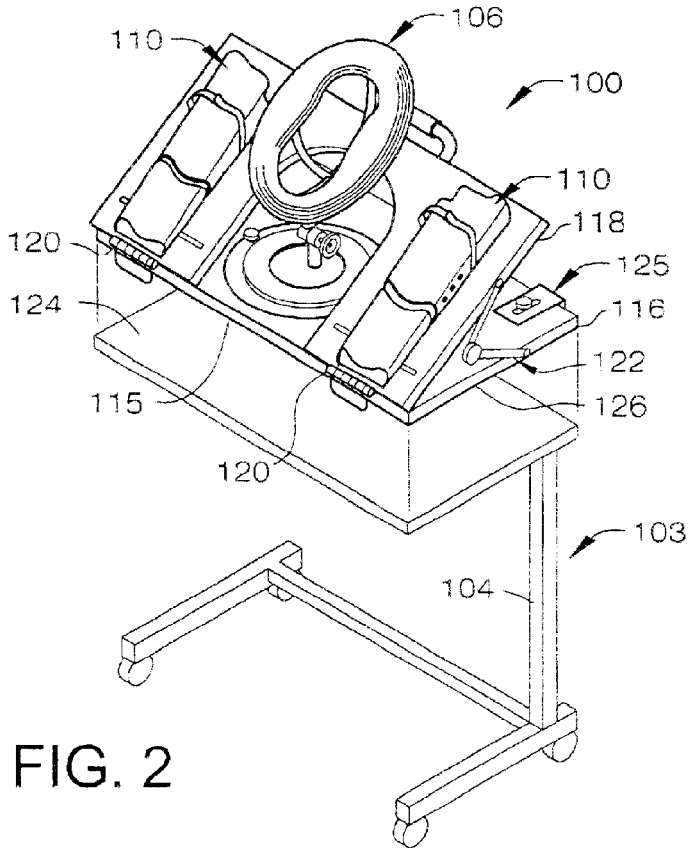
FIG. 2 is a perspective view of the sleep support system positioned on an over-bed table according to a preferred embodiment of the present invention.

FIG. 2 is a perspective view of the sleep support system in position on an over-bed table 104 according to a preferred embodiment of the present invention. Preferably, the sleep support system 100 may be placed on a portable fixture, such as an over-bed table 104, and rolled in position adjacent to the user (herein embodying at least one primary support removably rollable into a position such that, when such at least one intermediate support is being supported by such at least one primary support, such at least one face-support is in a location approximately above a position of the user's thighs). The sleep support system 100 preferably comprises an adjustable, ergonomically-formed head support assembly 106 adjustably mounted to an essentially planar, rectangular base panel 116 (herein embodying such at least one lower support member, structured and arranged to support such at least one face-incline-position adjuster on such at least one upper surface portion), and upper panel 118 (herein embodying at least one intermediate support, adapted to be supported by at least one primary support structured and arranged to support such intermediate support above a floor wherein; such at least one intermediate support is structured and arranged to support such at least one face support in a location approximately above a position of the user's thighs in such manner that the user's body is in a comfortable position for face-down sleep; and wherein such at least one intermediate support comprises at least one lower support member and at least one upper support member), as shown. Preferably, two adjustable, ergonomically-formed arm support assembly(ies) 110 (herein embodying at least one arm support structured and arranged to support at least one portion of the user's forearm in a comfortable position for sleep) are provided to support the arm of the user. Preferably, the arm support assembly(ies) 110 are adjustably mounted to an upper panel 118 (herein embodying at least one upper support member wherein such at least one upper support member is structured and arranged to support such at least one arm support), preferably, having a size and shape approximating the base panel 116. Preferably, the upper panel 118 is pivotally joined to the base panel 116 with at least one hinge 120 (herein embodying at least one hinge structured and arranged to hinge such at least one lower support member to such at least one upper support member), allowing the angle of inclination of the upper panel 118 and attached arm support assembly(ies) 110 to be raised or lowered relative to the base panel 116, as shown. Preferably, at least one angle adjusting mechanism 122 (herein embodying at least one arm-incline-position adjuster structured and arranged to provide incline-position adjustment of such at least one arm support) is mounted between the base panel 116 and upper panel 118 as a means for adjusting and fixing the upper panel 118 angle of inclination to a selected position.

The sleep support system 100 is preferably designed to rest on at least one primary support fixture 103. In a highly preferred embodiment of the present invention, the base panel 116 (herein embodying at least one lower support member) is sized to fit over an industry standard over-bed table 104, as shown. At least one preferred size of the base panel 116 is about 30 inches (76.2 cm) long by about 15 inches (38.1 cm) wide, approximating the size of the over-bed table support surface 124. Under appropriate circumstances, other size configurations for the base panel 116 are appropriate. Preferably, the sleep support system 100 utilizes the structure of the primary supporting fixture to transfer the supported weight of the sleep support system 100 to the floor or other support structures, allowing the sleep support system 100 to maintain an efficiently compact, easily stored configuration. Preferably, the lower surface 126 of the base panel 116 is provided with a movement resisting material 115 (herein embodying at least one movement resistor structured and arranged to resist relative movement between such at least one intermediate support and the at least one primary support when in adjacent position, wherein such at least one movement-resistor comprises at least one slip-resistant friction padding on an at least one lower surface portion of such at least one lower support) comprising at least one non-slip/non-damaging pad (preferably urethane or rubber pads) at contact areas with primary support. Under appropriate circumstances, at least one connector, preferably adjustable clamp 125 is used in conjunction with the movement resisting material 115 to firmly secure the system to the primary support fixture 103.

Figure 3:
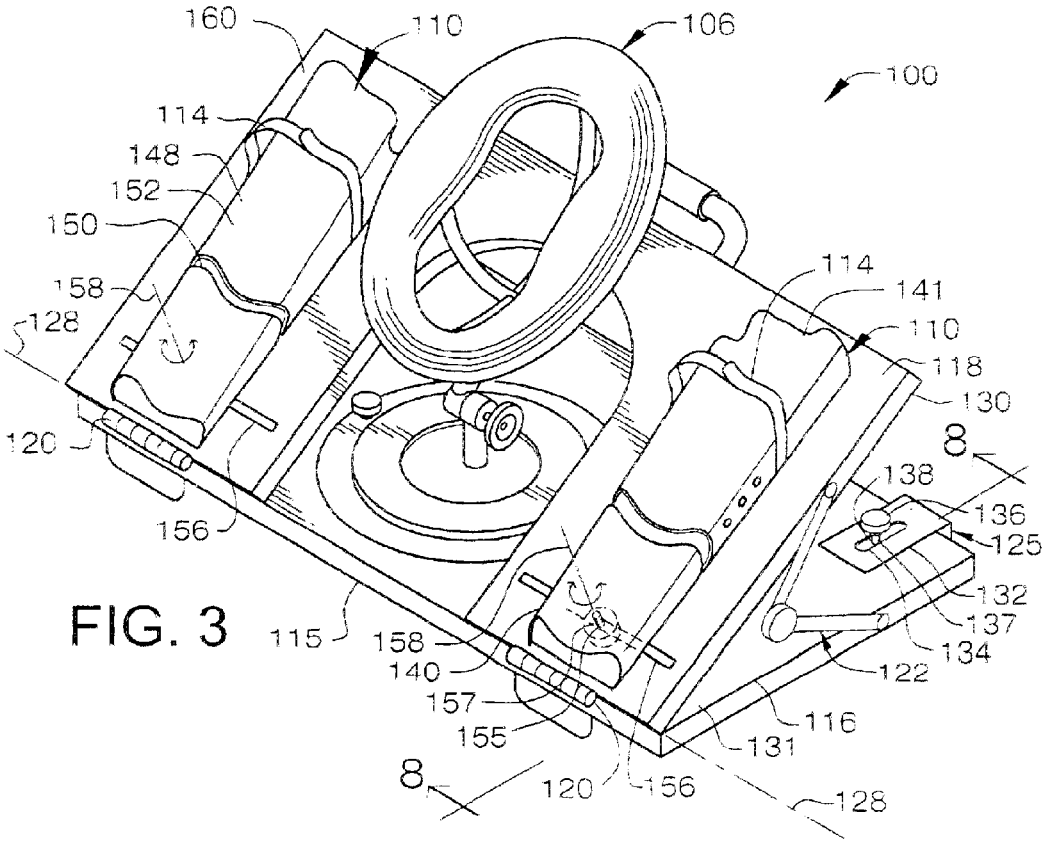
FIG. 3 is a perspective view of the sleep support system in operational position according to a preferred embodiment of the present invention.

FIG. 3 is a perspective view of the sleep support system 100 in operational position according to a preferred embodiment of the present invention. Preferably, as noted in FIG. 2, the upper panel 118 is pivotally joined to the base panel 116 with at least one hinge 120 (herein embodying an angle connection structured and arranged to connect such at least one lower support member at an acute angle with such at least one upper support member), allowing the upper panel 118 and attached arm support assembly(ies) 110 to rotate about an axis 128. Preferably, the hinge 120 (herein embodying at least one clamp structured and arranged to secure such at least one intermediate support to at least one primary support) is a commercially available butt-type hinge, preferably constructed of stainless steel. Preferably, the hinge is recessed into the lower surface 130 of the upper panel 118 and upper surface 131 of the base panel 116 to allow the two panels to fold fully flat (as further illustrated in FIG. 11). The hinge 120 is preferably fastened to the upper panel 118 and lower panel 116 permanently (e.g., by adhesives, welding, rivets, or similar fasteners appropriate to the substrate) or semi-permanently (e.g., with screws, or nuts and bolts or similar fasteners appropriate to the substrate). Under appropriate circumstances, in consideration of cost and ease of assembly, the hinging mechanism may be integrally formed with the upper panel 118 and lower panel 116. FIG. 3 illustrates an embodiment of the present invention utilizing at least one adjustable clamp 125, preferably used in conjunction with the movement resisting material 115, to assist in securing the system to at least one primary support fixture 103. Preferably, the adjustable clamp 125 comprises a "C" shaped bracket 132 having at least one elongated slot aperture 134, as shown. Preferably, the "C" shaped bracket 132 is adjustably mounted to the upper surface 131 of the lower panel 116 using at least one clamping knob 136, having a threaded shaft 137, passing through the elongated slot aperture 134 in the "C" shaped bracket 132, into a threaded aperture 138 located in the upper surface 131 of the base panel 116 (also shown in FIG. 8). Preferably, this allows the "C" shaped bracket 132 to adjustably slide along the threaded shaft 137 of the clamping knob 136 within the length of the elongated slot aperture 134. Preferably, the position of the bracket 132 is set when the clamping knob 136 is tightened, firmly securing the bracket 132 by friction, against upper surface 131 of the base panel 116. This adjustment preferably accommodates any variations in the width of the secondary support fixture. Preferably, a second clamping knob 142 is provided at the "C" shaped bracket 132 (visible in FIG. 8).

As described in FIG. 2, at least one arm support assembly 110 is used to support the arm of the user. In the preferred embodiment of FIG. 3, two arm support assembly(ies) 110 are shown, adjustably mounted to the upper panel 118.

Preferably, the arm support assembly 110 is formed in an ergonomic shape that approximates the surface contours of a human forearm and hand, as shown. The preferred cross-sectional shape of the upper portion 148 of the arm support assembly 110 is essentially concave, allowing for comfortable cradling of the user's forearm and hand. Preferably, the interior body 150 of the arm support assembly 110 is made from a molded plastic, such as polystyrene, ABS or rigid closed-cell foam. Under appropriate circumstances, other materials may suffice. Preferably, the interior body 150 of the arm support assembly 110 is covered with a resilient pad comprised of a deformable elastic material (preferably foam rubber or urethane foam) with a washable outer covering (preferably, vinyl or similar) that is sewn or formed to encapsulate the underlying elastic material. Under appropriate circumstances, the interior body 150 and resilient pad may be produced as a single composite assembly. Preferably, a second outer cover 152 (herein embodying at least one upper portion of such at least one arm support comprising at least one arm-support surface structured and arranged to be cleanable and moisture-permeable, such at least one arm-support surface portion adapted to contact at least one portion of the user's arm during face-down sleep) comprising a soft, cleanable and moisture-permeable material, such as fabric, lambs wool (or similar), is removably fastened over the resilient pad with hook and loop straps or snaps. Preferably, this second outer cover 152 serves as the surface in direct contact with the user. Those skilled in the art will appreciate that under appropriate circumstances, other materials and attachment means may be suitable. Preferably, at least one arm retention strap 114 comprised of soft nylon strapping is attached to the arm support assembly 110, as shown. The length of the arm retention strap 114 is adjustable by means of hook and loop fasteners or snaps. As described in FIG. 2, the arm retention strap(s) 114 aid the user in maintaining a comfortable position over the arm support assembly 110 during sleep. Under appropriate circumstances, other methods of maintaining user arm position may suffice.

Figure 9:
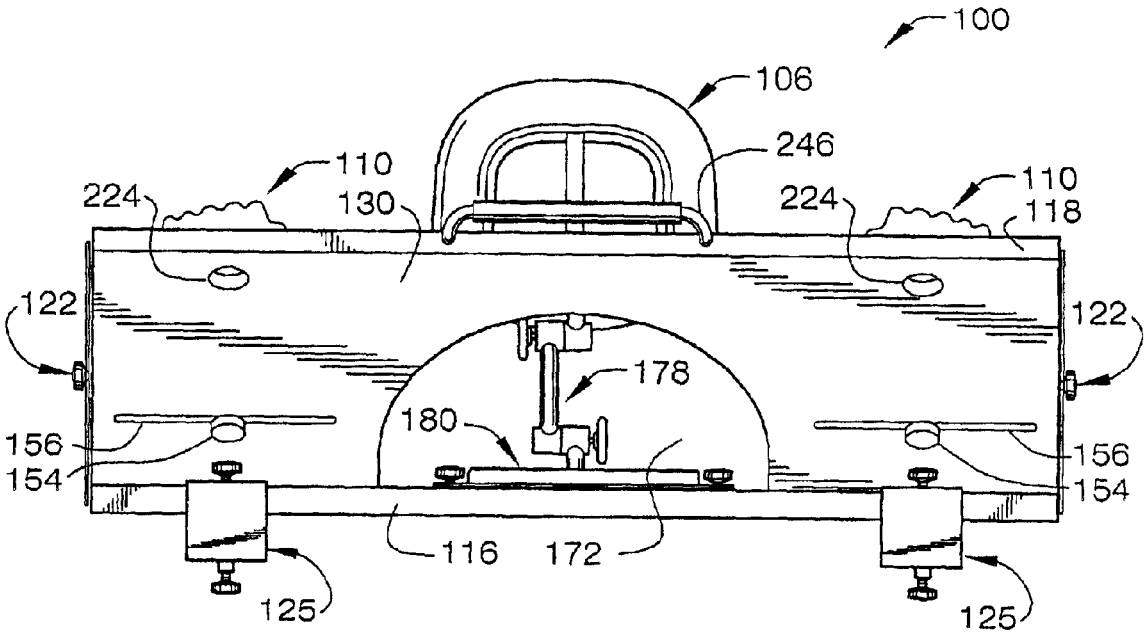
FIG. 9 is a rear elevational view of the sleep support system according to a preferred embodiment of the present invention.

The arm support assembly 110 is preferably mounted to the upper panel 118 using at least one clamping knob 154 (shown in FIG. 9), having a threaded shaft 155, passing from the lower surface 130 of the upper panel 118 through an elongated slot aperture 156 in the upper panel 118, to a threaded aperture 157 located on the underside of the arm support assembly 110 (also shown in FIG. 9). Preferably, the arm support assembly 110 is free to rotate about an axis 158, a pivot point set by the position of the threaded shaft 155, part of clamping knob 152 (herein embodying at least one arm-coplanar-position adjuster structured and arranged to provide coplanar position adjustment of such at least one arm support), as shown. This adjustment preferably accommodates the natural planar rotation of the arm toward and away from the midline of the body at the elbow (planar abduction/adduction). Preferably, the arm support assembly 110 is selectively movable laterally (relative to the central symmetry line of both the device and user) along the length of the slot aperture 156, as shown. This lateral adjustment feature is designed to accommodate the natural planar movement of the arm about the shoulder joint, as well as providing shoulder width adjustment to fit various sized users. Preferably, the position of the arm support assembly 110 is set when the clamping knob 154 (herein embodying at least one retainer, structured and arranged to retain such at least one arm-coplanar-position adjuster in a selected position) is tightened, firmly securing the arm support assembly 110 by friction, against upper surface 160 of the upper panel 118. Under appropriate circumstances, other methods of attaching and selectively positioning the arm support assembly 110 may suffice. Preferably, the sleep support system 100 further comprises at least one angle adjusting mechanism 122 for adjusting the upper panel 118 angle of inclination relative to the base panel 116, as shown.

Figure 4:
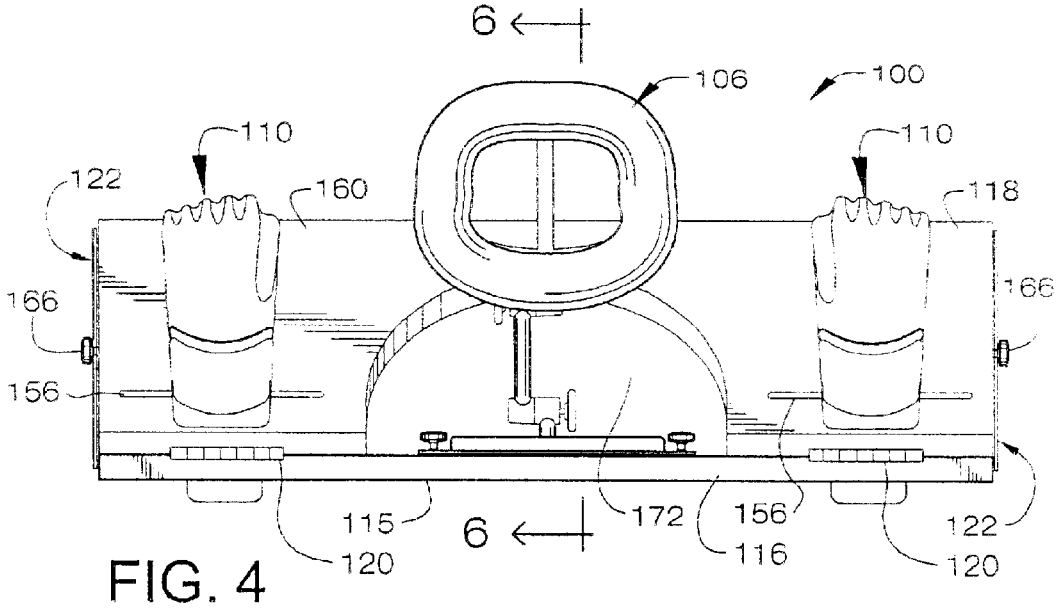
FIG. 4 is a front elevational view of the sleep support system according to a preferred embodiment of the present invention.

FIG. 4 is a front elevational view of the sleep support system. In the present embodiment, "front" refers to the side of the system facing the user. Preferably, the sleep support system 100 is essentially bilaterally symmetrical about the head support assembly 106. Preferably, the outer shape of the two arm support assembly(ies) 110, shown in FIG. 4, are symmetrically opposite, conforming to the right and left hands of the user. Preferably, an essentially "U" shaped peripheral opening 172, centrally located in the upper panel 118, allows the head support assembly 106 to extend from its mounting point on the base panel 116 to an elevated position, allowing user access, as shown. Preferably, the diameter and width of the "U" shaped peripheral opening 172 is about 12 inches (30.48 cm), as shown. Under appropriate circumstances, other opening configurations may suffice. In the preferred embodiment, two symmetrically located hinge(s) 120 are approximately centered between the outer edge of the upper panel 118 and inner edge of the "U" shaped peripheral opening 172, as shown.

Figure 5:
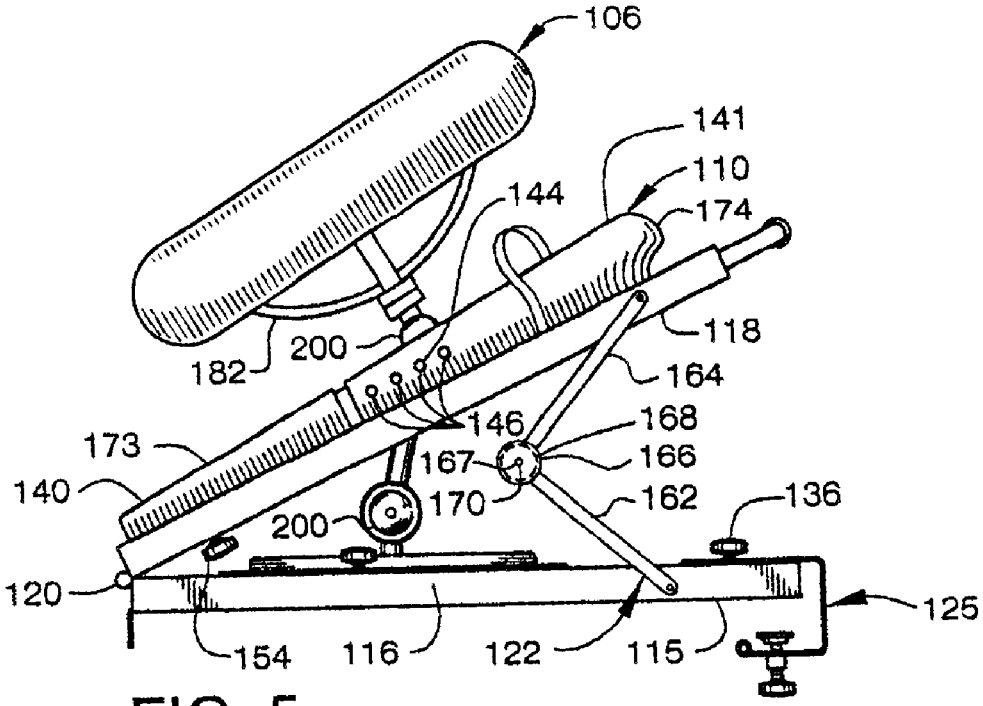
FIG. 5 is a side elevational view of the sleep support system according to a preferred embodiment of the present invention.

FIG. 5 is a side elevational view of the sleep support system. In FIG. 5, the relative thickness of the upper panel 118 and lower panel 116 are visible. Preferably, the thickness of both the upper panel 118 and lower panel 116 is about ¾ inch (1.91 cm). Also shown in FIG. 5 is the slightly tapered profile of the arm support assembly 110. Preferably, the thickness of the arm support assembly 110 increases from the lower forearm-supporting portion 173 to the upper gripping-portion 174, allowing the user to grasp the upper portion of the arm support assembly 110 without impinging on the upper panel 118. To accommodate a range of user arm lengths, the arm support assembly 110 is preferably constructed, in at least two parts, with at least one first arm support segment 140, slidably engaging at least one second arm support segment 141 (in a telescopic fashion), as shown.

Preferably, at least one spring lock 144 (e.g., a spring-loaded push button engaging a retaining indentation or hole) that is set and released by hand action by the user is provided to adjust and fix the position of the first arm support segment 140 relative to the second arm support segment 141, as shown. Preferably, by releasing the spring lock 144 from the retaining indentation 146 and telescopically sliding the second arm support segment 141 relative to the first arm support segment 140, the overall length of the arm support assembly 110 may be adjusted. Preferably, four retaining indentation(s) 146 are shown, generally located along the outer sides of the arm support assembly(ies) 110 to allow for convenient user access. Other quantities of retaining indentation(s) 146 are within the scope of the invention. Additional arm support assembly length adjustments can be provided, for example, by means of additional retaining indentation(s) 146. Those skilled in the art will appreciate that, under appropriate circumstances, other arrangements for releasably locking the arm support segments may suffice. Preferably, the average length of the arm support assembly 110 is about 18 inches (45.72 cm).

Preferably, the sleep support system 100 further comprises at least one angle adjusting mechanism 122 for adjusting the upper panel 118 angle of inclination relative to the base panel 116, as shown. Preferably, the upper panel 118 can be lifted and locked in an infinite number of selected positions between the raised position and the lowered position. The preferred range of angular adjustment for the upper panel 118, about an axis 128, is between about 0 and about 90 degrees. Preferably, the angle adjusting mechanism 122 comprises at least one first strut 162, with at least one proximal end pivotally mounted to the base panel, and at least one second strut 164, with at least one proximal end pivotally mounted to the upper panel, as shown. Preferably, distal ends of the first strut 162 and second strut 164 loosely engage at least one clamping knob 166 having a threaded shaft 167 and at least one receiver plate 168 having a corresponding threaded aperture 170. With the clamping knob 166 disengaged, the first strut 162 and second strut 164 are free to pivot about the axis of the threaded shaft 167. By tightening the clamping knob 166 (herein embodying at least one retainer, structured and arranged to retain such at least one arm-incline-position adjuster in a selected position), the receiver plate 168 is drawn tightly against the first strut 162 and second strut 164, thereby rigidly locking the assembly, by friction, at a selected angle (simultaneously fixing the relative positions of the upper panel 118 and base panel 116). Under appropriate circumstances, other methods of selectively setting the angle of inclination of the upper panel 118 may suffice. As an example, each distal end of both first strut 162 and second strut 164 may further comprise an opposing set of radially positioned teeth that, when meshed, prevent pivotal movement of the first strut 162 and second strut 164 about the longitudinal axis of the threaded shaft 167.

Figure 6:
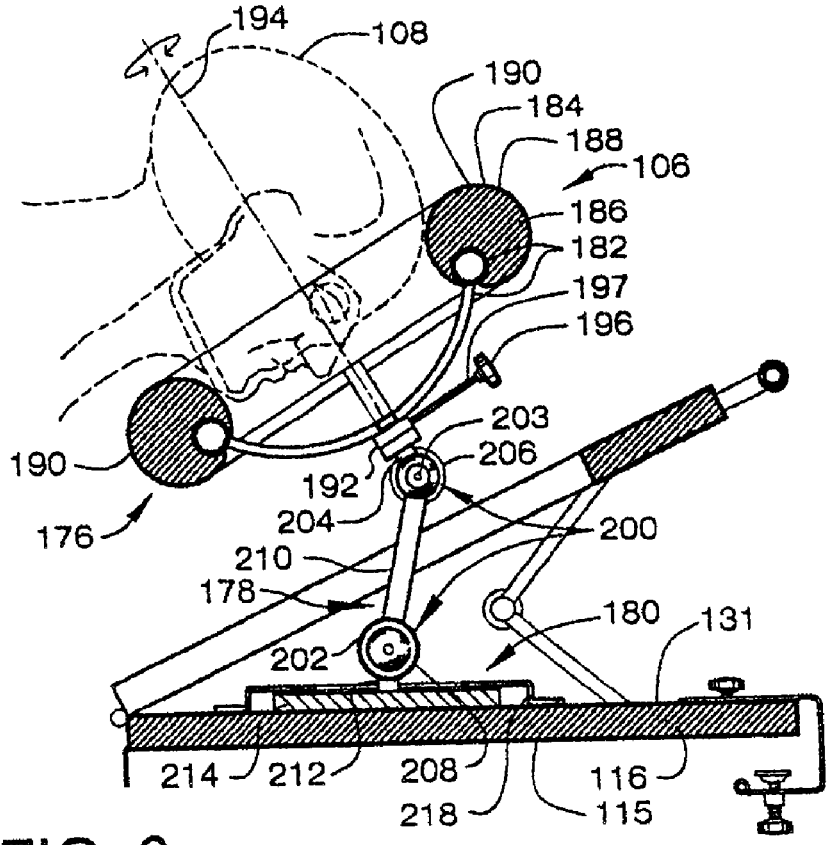
FIG. 6 is a sectional view, through section 6—6 of FIG. 4, depicting the sleep support system according to a preferred embodiment of the present invention.

FIG. 6 is a sectional view, through section 6—6 of FIG. 4, depicting the sleep support system. Shown in FIG. 6 is the preferred construction of the head support assembly 106. Preferably, the head support assembly 106 comprises three major components; at least one face-supporting headrest 176, at least one articulated support arm 178, and at least one adjustable base 180, as shown. Preferably, the headrest 176 comprises an ergonomically-shaped, approximately oval headrest support frame 182, comprising tubular steel or rigid plastic, as shown. Alternately, under appropriate circumstances, a flat steel or plastic plate may be used. Preferably, at least one cushion 184 is semi-permanently fastened to the headrest support frame 182 with hook and loop straps, snaps, screws or similar appropriate fasteners. The cushion 184 preferably comprises a deformable elastic core 186 (foam rubber or urethane foam) with a washable outer covering 188 (vinyl or similar) that is sewn or formed to encapsulate the elastic core, as shown. Preferably, a second outer cover 190 (herein embodying at least one upper portion of such at least one face support comprising at least one surface portion structured and arranged to be cleanable and moisture-permeable, such at least one surface portion adapted to contact at least one portion of the user's face during face-down sleep) made from soft, cleanable and moisture-permeable material, such as fabric, lambs wool (or similar) material is removably fastened over the cushion 184 with hook and loop straps or snaps. Preferably, this second outer cover 190 serves as the direct contact surface with the user. Those skilled in the art will appreciate that under appropriate circumstances, other materials and attachment means may be suitable. Preferably, at least one support arm is provided to support the headrest, as shown. Preferably, the headrest support frame 182 is mounted to the upper portion of a rotatably adjustable swivel body 192, as shown. The swivel body 192 preferably encloses a planetary bearing assembly to facilitate rotation of the headrest 176. Central placement of the rotational axis 194 of the swivel body in relation to the headrest (and the supported head) accommodates normal lateral abduction and adduction of the user's head (movement away/toward the body midline) during use.

Preferably, this rotational axis 194 coincides with an anterior-posterior axis passing through the approximate center of the supported head, along or near the midsagittal plane (midline dividing the body into right and left halves). Preferably, the user's supported head is free to rotate one hundred and eighty degrees both right and left about the axis 194. Preferably, the swivel body comprises at least one clamping knob 196 having a threaded shaft 197, that when tightened, firmly secures the upper portion of the swivel body 192 against rotation, allowing the headrest 176 to be locked at any selected position.

Preferably, the lower portion of the swivel body is adapted to accept the distal (upper) end of at least one articulated support arm 178 (herein embodying at least one face-incline-position adjuster structured and arranged to adjust the incline-position of support of the user's face for preferred sleep), as shown. Preferably, the articulated support arm 178 is a modified commercially available unit, preferably similar in specification to the Manfrotto articulated variable friction arm model D303, Bogen Photo Corporation, Ramsey, N.J., USA. Those skilled in the art will appreciate that under appropriate circumstances, the articulated support arm 178 may comprise a unit that is custom fabricated, commercially available, or a combination of both. Preferably, the articulated support arm 178 comprises at least three separate arm segments of adjustable length, pivotally connected to at least two lockable pivot joint(s) 200, as shown. The locking pivot joint(s) 200 are preferably adapted to provide a range of rotational movement between the adjacent support arm segments 198. Preferably, the lockable pivot joint 200 has a locking/releasing mechanism, preferably comprising at least one clamping knob 202 (herein embodying at least one retainer, structured and arranged to retain such at least one face-incline-position adjuster in a selected position) having a threaded shaft 203, that when tightened, firmly secures the pivot joint 200 at a preferred angle, preventing movement when the resting weight of the user is applied to the head support assembly 110. Preferably, the pivot joint(s) 200 operate on a friction retention basis, allowing an infinite number of selected positions within its range of movement. Preferably, the three arm segments 198 are each threadably attached to its neighboring structure. Preferably, the first arm segment 204 (preferably constructed from a hollow rigid plastic, aluminum or stainless steel tube) is threaded to the swivel body 192, and to a first lockable pivot joint 206, as shown. Preferably, the length of the first arm segment 204 is about 1 inch (2.54 cm). Preferably, a second lockable pivot joint 208 is joined to the first lockable pivot joint 206 by a second arm segment 210 having a length of between about 8 inches and about 12 inches (20.32 cm and 30.48 cm), as shown. Preferably, a third arm segment 212 having a length of about 1 inch (2.54 cm), joins the second lockable pivot joint 208 to at least one adjustable base 180, as shown.

Preferably, the adjustable base 180 comprises at least one base plate 214 comprising a 1" thick (2.54 cm), round planar disk having a diameter of about 7". Preferably, the base plate 214 comprises stainless steel, rigid plastic or lightweight metal, such as aluminum. Preferably, mounted approximately at the center of the upper side of the base plate 214, is a threaded stud 216, adapted to receive the proximal end of the third arm segment 212. The opposite side of the base plate 214 rests on the upper surface 131 of the base panel 116. The head support assembly base plate 214 is retained in position on base panel 116 using at least one clamping ring 218.

Figure 7:
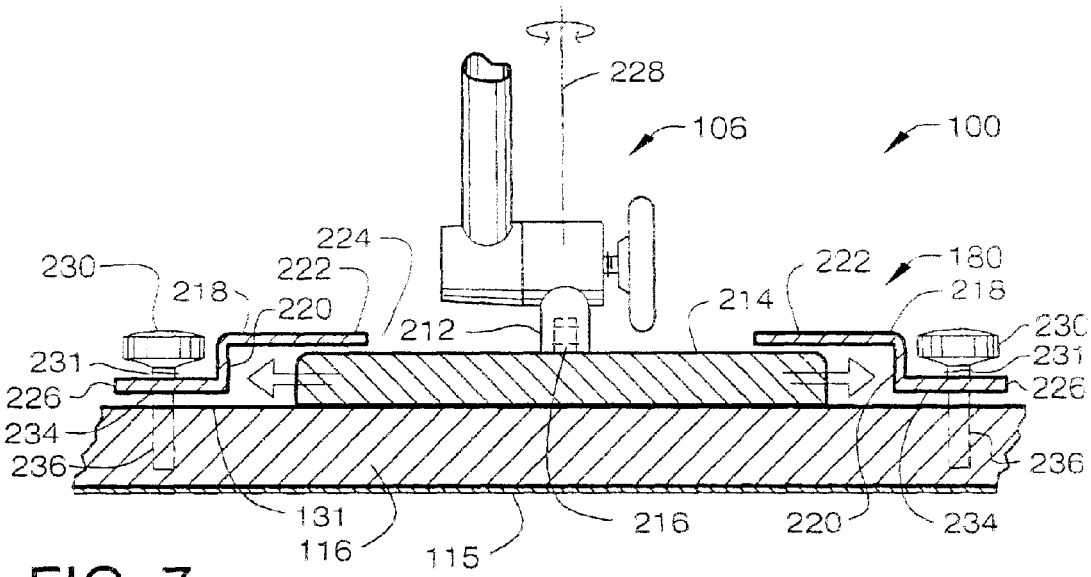
FIG. 7 is a partial sectional view of the adjustable base of the sleep support system according to a preferred embodiment of the present invention.

FIG. 7 shows a partial sectional view 7—7 of FIG. 6. FIG. 7 shows in detail, the various preferred assemblies of the adjustable base 180 and clamping ring 218. Preferably, the clamping ring 218 comprises a generally hat-shaped bracket having at least one vertical annular wall 220, with an interior diameter of about 10" (20.54 cm) and a height slightly less than the thickness of the base plate 214. Preferably, an annular-shaped upper flange 222 projects radially inward from the top of the vertical annular wall 220 to form a 4" diameter aperture 224 adapted to pass the head support assembly 110, as shown. Preferably, an annular-shaped lower flange 226 (having an outer edge diameter of about 12 inches (30.48 cm) projects radially outward from the bottom of the vertical annular wall 220, as shown. Preferably, the clamping ring 218 is adapted to fit over the base plate 214, firmly locking the base plate 214 against the upper surface 131 of the base panel 116 at a selected position. The interior diameter of the clamping ring 131 is approximately 30 percent larger than the outer diameter of the base plate 214, affording the head support assembly 110 a free range of motion both rotationally about the vertical axis of the third arm segment 212 (axis 228) and linearly across the upper surface 131 of the base panel 116, when the clamping ring 218 is disengaged. Preferably, the clamping ring 218 is adjustably mounted to the upper surface 131 of the base panel 116 using at least one clamping knob 230, having a threaded shaft 231 that passes through an aperture 234 in the annular-shaped lower flange 226, into a threaded aperture 236, located in the upper surface 131 of the base panel 116, as shown. Preferably, the clamping ring 218 is engaged when the interior surface of the annular-shaped upper flange 222 (of clamping ring 218) is tightened against the upper surface of the base plate 214 by the tightening of the clamping knob 230 against the annular-shaped lower flange 226 of the clamping ring. Preferably, by selectively setting the adjustable elements of the head support assembly 110, a high degree of flexibility is afforded the user in his/her selection of sleep positions.

Figure 8:
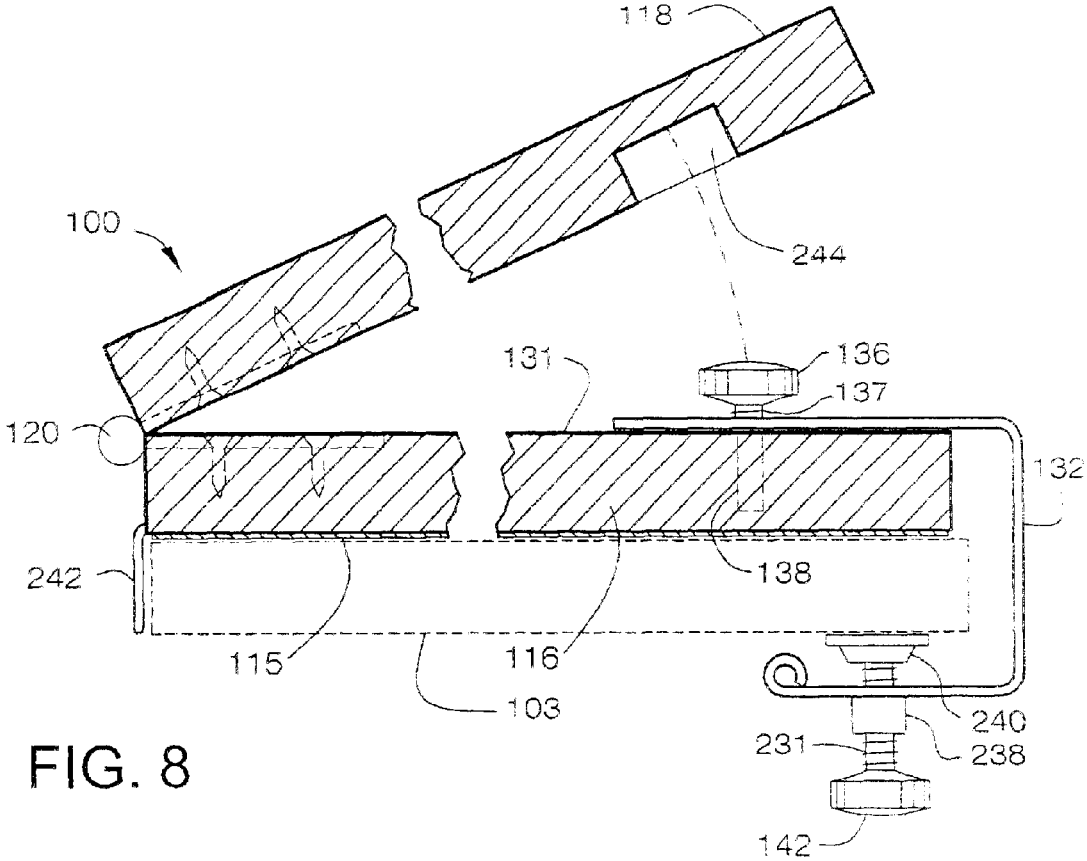
FIG. 8 is a partial sectional view, through section 8—8 of FIG. 3, showing the movement restraint arrangement of the sleep support system according to a preferred embodiment of the present invention.

FIG. 8 is a partial sectional view of the upper panel 118 and base panel 116, including the movement restraint arrangement of the sleep support system 100. As described in FIG. 3, under appropriate circumstances, at least one "C" shaped bracket 132 is adjustably mounted to the upper surface 131 of the base panel 116 using at least one clamping knob 136, having a threaded shaft 137, passing through the "C" shaped bracket 132 and into a threaded aperture 138 located in the upper surface 131 of the base panel 116, as shown. Preferably, all threaded apertures located within the upper panel 118, base panel 116 and arm support assembly 110 are metallic inserts, cast or pressed into the plastic structure of the respective assembly or, under appropriate circumstances, integrally formed into the material of the respective assembly (under appropriate circumstances, other adjustable methods of attachment may suffice). In an alternate preferred embodiment, the "C" shaped bracket 132 may be recessed into the upper surface of the base panel to allow the upper panel 118 to fold fully flat against the base panel 116. Preferably, as noted in FIG. 3, a second clamping knob 142 having a threaded shaft 143 is provided at the lower leg of the "C" shaped bracket 132, as shown. Preferably, the second clamping knob 142 is adapted to secure the base panel 116 to the primary support fixture 103, as shown. Preferably, the threaded shaft 143 of the second clamping knob 142 passes through a threaded segment 238 of the "C" shaped bracket 132, as shown. Preferably, at least one articulated foot 240, with a protective rubber contact face, is provided at the end of the threaded shaft 231, as shown (those skilled in the art will appreciate that the configuration of the second clamping knob is of a well-known and commercially available type and that under appropriate circumstances, other movement-resisting methods may suffice). Preferably, the sleep support system 100 is firmly secured to the primary support fixture 103 when the second clamping knob 142 is turned, pressing the articulated foot 240 against the primary support fixture 103, thereby drawing the lower surface 126 of the base panel 116 against at least one upper surface of the primary support 103, as shown.

Preferably, at least one applied metallic (or integrally formed plastic) stop 242, located at the front edge of the base panel 116, is adapted to hook over the edge of the primary support fixture 103, thereby restricting slippage between the base panel 116 and the primary support fixture 103, as shown.

Figure 10:
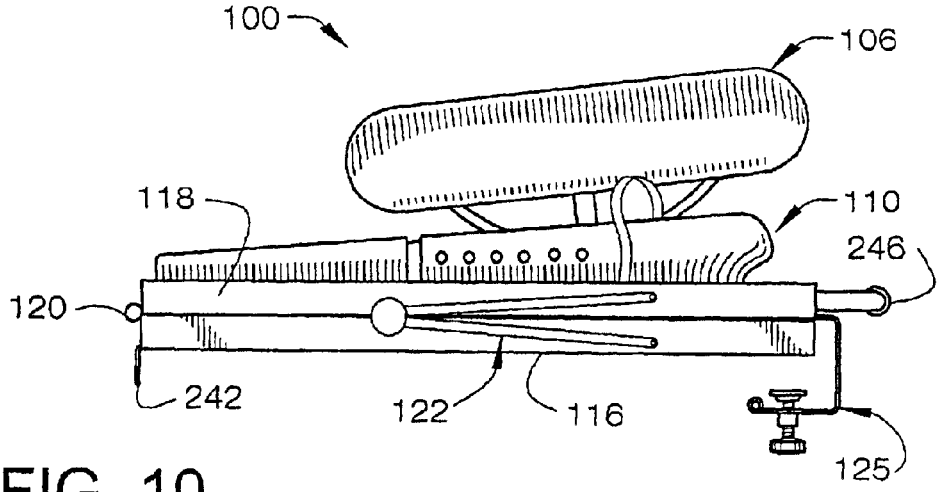
FIG. 10 is a side elevational view of the sleep support system in a folded position according to a preferred embodiment of the present invention.

Preferably, clearance cavities 244 in the upper panel 118 and lower panel 116 are formed, as required, to accommodate any projecting assembly that would otherwise prevent the upper panel 118 and lower panel 116 to be folded flat (as shown in FIG. 10).

FIG. 9 is a rear elevational view of the sleep support system. In the present embodiment, "rear" refers to the side of the system facing away from the user. Preferably, as in the front view, the sleep support system 100 is essentially bilaterally symmetrical about the head support assembly 106. Under appropriate circumstances, a pair of adjustable clamp(s) 125 are used to secure the device to the primary support fixture 103, as shown. In the rear elevational view, the preferred clamping knob(s) 154 are clearly shown passing from the underside of the upper panel 118 through the elongated slot apertures 156 into the threaded apertures 157 located on the underside of the arm support assembly(ies) 110. Fully visible in FIG. 9 is at least one handle 246, preferably mounted to the rear edge of the upper panel 118, provided to facilitate carrying the device.

FIG. 10 is a side elevational view of the sleep support system in a folded position. Preferably, the sleep support system 100 is designed to fold into an essentially flat configuration for storage or transport, as shown. Under appropriate circumstances, any or all of the sub-components of the sleep support system can removed for separate storage or service replacement as required. Although the preferred embodiment describes a fully folding system, under appropriate circumstances, fixed or semi-folding units are within the scope of the invention.

Figure 11:
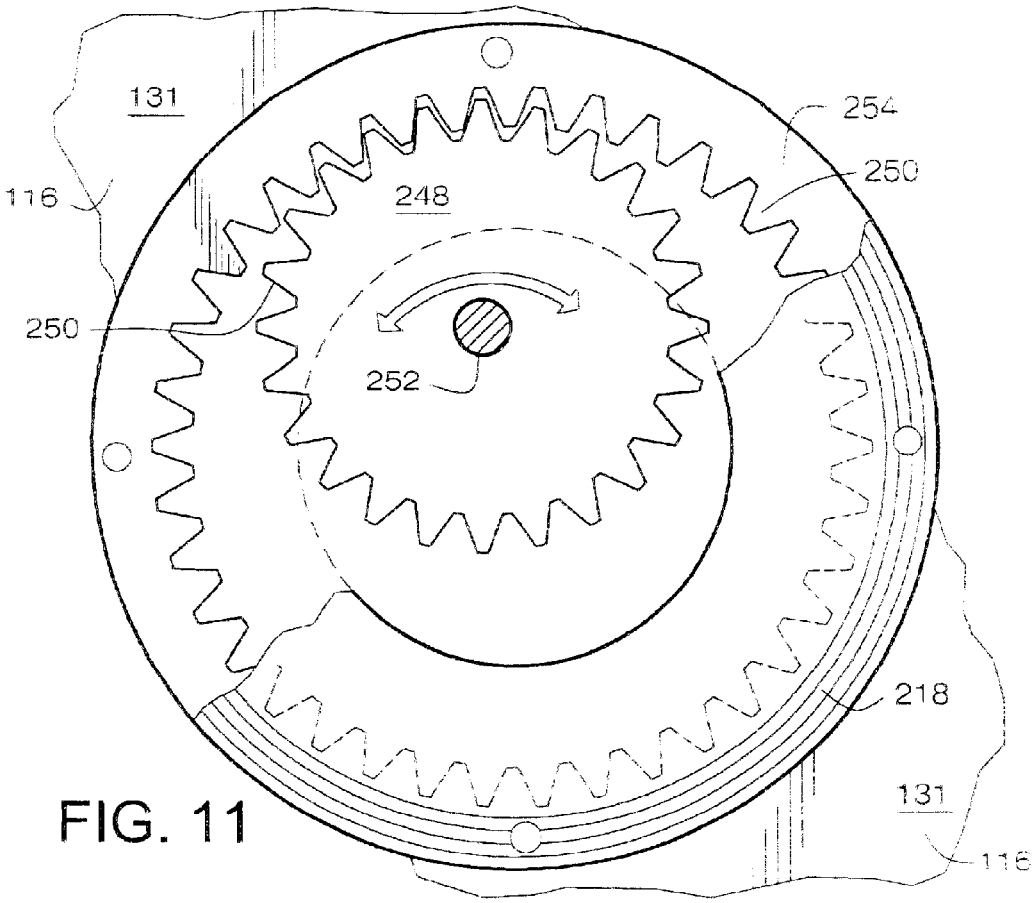
FIG. 11 is a partial sectional view of an alternate preferred embodiment of the head support base plate of a sleep support system according to a preferred embodiment of the present invention.

FIG. 11 is a partial sectional view of an alternate preferred embodiment of the adjustable base assembly of the sleep support system 100. The alternate adjustable base assembly preferably comprises at least one eccentrically located inner gear 248 having external teeth 250 formed around its outer circumferential periphery, as shown. Preferably, centrally mounted on the upper side of the inner gear 248 is a threaded stud 252, adapted to receive the proximal end of the third arm segment 212. Preferably, at least one outer ring gear 254 is removably mounted to the upper surface 131 of the lower support panel 116, as shown. The outer ring gear 254 preferably comprises teeth 250 formed around its inner circumferential periphery, as shown. The teeth of the inner gear 248 and outer ring gear 254 are adapted to intermesh such that the inner gear 248 may rotate around the interior periphery of the outer ring gear 254. Preferably, a clamping ring 218 (similar to the clamping ring described in FIG. 7) is used to lock the inner gear 248 at a desired position. Under appropriate circumstances, mechanical and electromechanical actuators may be used to operate the various adjustable components of the sleep support system, including the inner gear 248, without exceeding the scope of the present invention. Those skilled in the art will appreciate that the use of electric drive motors with various types of transmission and linkage elements, including gear and screw drives, are well-known in the art and may be used to cause relative movement between portions of the sleep support system. Under appropriate circumstances, electromechanical, hydraulic, all types (including any combination of the above-noted elements) may be utilized for adjusting portions of the sleep support system.

Figure 12:
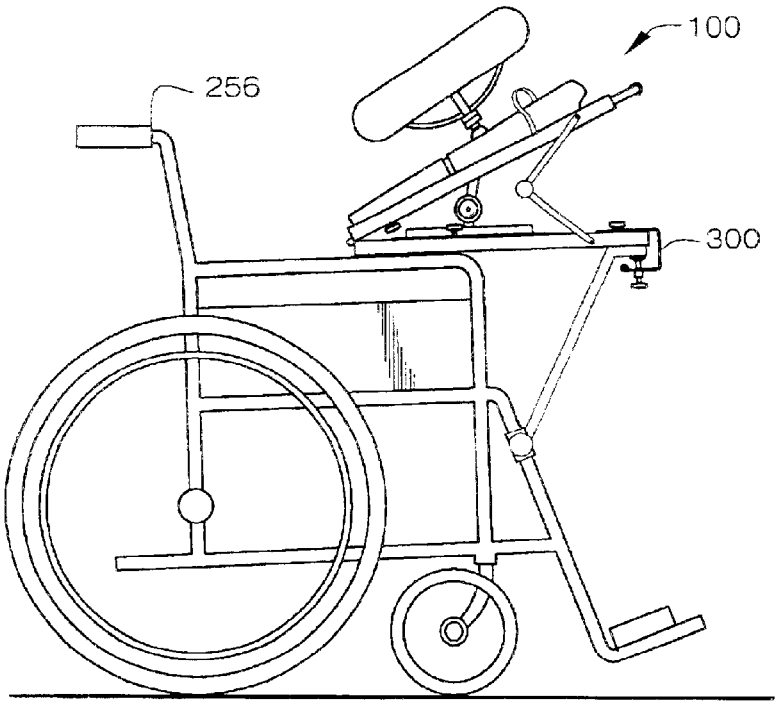
FIG. 12 is a side elevational view of the sleep support system adapted for use with a wheelchair according to a preferred embodiment of the present invention.

FIG. 12 is a side elevational view of the sleep support system 100 adapted for use with a wheelchair 256 according to a preferred embodiment of the present invention. Preferably, the sleep support system may be adapted to a wheelchair, bed, or similar body support device (herein embodying at least one body support adapted to support a user's body so that the user's buttocks and thighs are in an approximately horizontal position wherein such at least one body support comprises such at least one primary support), as shown. As shown, at least one connector 300, preferably a clamp, is preferably used to support sleep support system 100 in the desired position.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. A sleep support system for face-down sleep in essentially a sitting position, for use with at least one body support adapted to support a user's body so that the user's buttocks and thighs are in an approximately horizontal position, the system comprising in combination:

a) at least one face support structured and arranged to support a user's face during face-down sleep with the user's nose unobstructed for breathing; and b) at least one intermediate support, adapted to be supported by at least one primary support structured and arranged to steadily support said intermediate support above a floor;

c) wherein said at least one intermediate support is structured and arranged to support said at least one face support in a location approximately above a position of the user's thighs in such a manner that the user's body is in a comfortable position for face-down sleep;

d) wherein said at least one intermediate support comprises at least one face-incline-position adjuster structured and arranged to adjust the incline-position of support of the user's face for preferred sleep; and e) wherein at least one upper portion of said at least one face support comprises at least one surface portion structured and arranged to be cleanable and moisture-permeable, said at least one surface portion adapted to contact at least one portion of the user's face during face-down sleep.

2. The sleep support system according to claim 1 wherein said sleep support system is portable.

3. The sleep support system according to claim 2 wherein said at least one intermediate support comprises at least one movement resistor structured and arranged to resist relative movement between said at least one intermediate support and the at least one primary support when in adjacent position.

4. The sleep support system according to claim 2 wherein said at least one intermediate support comprises at least one arm support structured and arranged to support at least one portion of the user's forearm in a comfortable position for sleep.

5. The sleep support system according to claim 4 wherein at least one upper portion of said at least one arm support comprises at least one arm-support surface structured and arranged to be cleanable and moisture-permeable, said at least one arm-support surface portion adapted to contact at least one portion of the user's arm during face-down sleep.

6. The sleep support system according to claim 5 wherein said at least one intermediate support comprises at least one arm-incline-position adjuster structured and arranged to provide incline-position adjustment of said at least one arm support.

7. The sleep support system according to claim 6 wherein:

a) said at least one intermediate support comprises at least one lower support member and at least one upper support member;

b) an angle connection structured and arranged to connect said at least one lower support member at an acute angle with said at least one upper support member; and c) said at least one lower support member is structured and arranged to support said at least one face-incline-position adjuster on at least one upper surface portion of said lower support member.

8. The sleep support system according to claim 7 wherein said at least one upper support member is structured and arranged to support said at least one arm support.

9. The sleep support system according to claim 8 wherein said angle connection comprises at least one hinge structured and arranged to hinge said at least one lower support member to said at least one upper support member.

10. The sleep support system according to claim 9 wherein said at least one face-incline-position adjuster and said at least one arm-incline-position adjuster are independently adjustable.

11. The sleep support system according to claim 10 wherein said at least one upper support member comprises:

a) at least one arm-coplanar-position adjuster structured and arranged to provide coplanar position adjustment of said at least one arm support;

b) wherein said at least one arm-incline-position adjuster and at least one arm-coplanar-position adjuster are independently adjustable.

12. The sleep support system according to claim 11 wherein each said at least one face-incline-position adjuster comprises at least one retainer, structured and arranged to retain said at least one face-incline-position adjuster in a selected position, while the user is supported by said sleep support system during the face-down sleep.

13. The sleep support system according to claim 12 wherein each said at least one arm-incline-position adjuster comprises at least one retainer, structured and arranged to retain said at least one arm-incline-position adjuster in a selected position, while the user is supported by said sleep support system during the face-down sleep.

14. The sleep support system according to claim 13 wherein each said at least one arm-coplanar-position adjuster comprises at least one retainer, structured and arranged to retain said at least one arm-coplanar-position adjuster in a selected position, while the user is supported by said sleep support system during the face-down sleep.

15. The sleep support system according to claim 12 wherein said at least one movement-resistor comprises at least one slip-resistant friction padding on an at least one lower surface portion of said at least one lower support.

16. The sleep support system according to claim 12 wherein said at least one movement-resistor comprises at least one connector structured and arranged to secure said at least one intermediate support to at least one primary support.

17. The sleep support system according to claim 1 wherein said at least one face support comprises at least one substantially oval annular face support.

18. A sleep support system for face-down sleep in essentially a sitting position, for use with at least one body support, adapted to support a user's body so that the user's buttocks and thighs are in an approximately horizontal position, the system comprising in combination:

a) at least one face support structured and arranged to support a user's face during face-down sleep with the user's nose unobstructed for breathing; and b) at least one intermediate support;

c) at least one primary support structured and arranged to steadily support said intermediate support above a floor;

d) wherein said at least one intermediate support is structured and arranged, in combination with said primary support, to support said at least one face support in a location approximately above a position of the user's thighs in such manner that the user's body is in a comfortable position for face-down sleep;

e) wherein said at least one intermediate support comprises at least one face-incline-position adjuster structured and arranged to adjust the incline-position of support of the user's face for preferred sleep; and f) wherein at least one upper portion of said at least one face support comprises at least one surface portion structured and arranged to be cleanable and moisture-permeable, said at least one surface portion adapted to contact at least one portion of the user's face during face-down sleep.

19. The sleep support system according to claim 18 wherein said at least one primary support is removably rollable into a position such that, when said at least one intermediate support is being supported by said at least one primary support, said at least one face-support is in a location approximately above a position of the user's thighs.

20. The sleep support system according to claim 18 wherein said at least one primary support comprises said at least one body support.

21. The sleep support system according to claim 20 wherein a) said at least one intermediate support comprises at least one movement resistor structured and arranged to resist relative movement between said at least one intermediate support and the at least one primary support when in adjacent position b) said at least one movement-resistor comprises at least one connector structured and arranged to secure said at least one intermediate support to said at least one primary support.

22. The sleep support system according to claim 20 wherein said at least one intermediate support is portable.

23. A sleep support system for face-down sleep in essentially a sitting position, comprising, in combination:

a) at least one body support adapted to support a user's body so that the user's buttocks and thighs are in an approximately horizontal position;

b) at least one face support structured and arranged to support a user's face during face-down sleep with the user's nose unobstructed for breathing;

c) at least one intermediate support;

d) at least one primary support structured and arranged to support said intermediate support above a floor;

e) wherein said at least one intermediate support is structured and arranged, in combination with said primary support, to support said at least one face support in a location approximately above a position of the user's thighs in such manner that the user's body is in a comfortable position for face-down sleep;

f) wherein said at least one intermediate support comprises at least one face-incline-position adjuster structured and arranged to adjust the incline-position of support of the user's face for preferred sleep; and g) wherein at least one upper portion of said at least one face support comprises at least one surface portion structured and arranged to be cleanable and moisture-permeable, said at least one surface portion adapted to contact at least one portion of the user's face during face-down sleep.

24. The sleep support system according to claim 23 wherein said at least one primary support is removably rollable into a position such that, when said at least one intermediate support is being supported by said at least one primary support, said at least one face-support is in a location approximately above a position of the user's thighs.

25. The sleep support system according to claim 23 wherein a) said at least one intermediate support comprises at least one movement resistor structured and arranged to resist relative movement between said at least one intermediate support and the at least one primary support when in adjacent position b) said at least one movement-resistor comprises at least one connector structured and arranged to secure said at least one intermediate support to said at least one primary support.

26. The sleep support system according to claim 23 wherein said at least one body support comprises said at least one primary support.

* * * * *